US009030373B2

(12) United States Patent
Sim

(10) Patent No.: US 9,030,373 B2
(45) Date of Patent: May 12, 2015

(54) TRANSPARENT FILM FOR REDUCING ELECTROMAGNETIC WAVES AND METHOD OF MANUFACTURING THE SAME

(71) Applicant: Electronics and Telecommunications Research Institute, Daejeon (KR)

(72) Inventor: Dong-Uk Sim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 287 days.

(21) Appl. No.: 13/646,565

(22) Filed: Oct. 5, 2012

(65) Prior Publication Data

US 2013/0088408 A1 Apr. 11, 2013

(30) Foreign Application Priority Data

Oct. 7, 2011 (KR) ..... 10-2011-0102530

(51) Int. Cl.
*H01Q 15/02* (2006.01)
*H01Q 1/24* (2006.01)
*H01Q 17/00* (2006.01)

(52) U.S. Cl.
CPC ..... *H01Q 1/243* (2013.01); *H01Q 17/00* (2013.01)

(58) Field of Classification Search
CPC .... H01Q 17/00; H01Q 15/0013; H01Q 1/243
USPC ..... 343/909, 841, 702
See application file for complete search history.

(56) References Cited

U.S. PATENT DOCUMENTS

| | | | | |
|---|---|---|---|---|
| 6,552,690 | B2 * | 4/2003 | Veerasamy | 343/713 |
| 7,847,753 | B2 * | 12/2010 | Ishibashi et al. | 343/897 |
| 2005/0174290 | A1 * | 8/2005 | Huang | 343/700 MS |
| 2007/0042654 | A1 | 2/2007 | Arakawa et al. | |
| 2009/0051258 | A1 | 2/2009 | Kim et al. | |
| 2010/0019988 | A1 | 1/2010 | Kim et al. | |

FOREIGN PATENT DOCUMENTS

| | | | |
|---|---|---|---|
| KR | 10-2003-0051394 | A | 6/2003 |
| KR | 10-2006-0099874 | A | 9/2006 |
| KR | 10-2007-0061155 | A | 6/2007 |
| KR | 10-2009-0021009 | A | 2/2009 |
| WO | WO 2006/098587 | A1 | 9/2006 |

* cited by examiner

*Primary Examiner* — Hoang V Nguyen

(57) ABSTRACT

A method of manufacturing a transparent film for reducing electromagnetic waves includes forming a first dielectric layer and forming a pattern layer on the first dielectric layer. The pattern layer is made of a transparent electrode material having surface resistance.

18 Claims, 9 Drawing Sheets

TRANSPARENT FILM FOR REDUCING ELECTROMAGNETIC WAVES AND METHOD OF MANUFACTURING THE SAME

CROSS-REFERENCE TO RELATED APPLICATION(S)

The present invention claims priority of Korean Patent Application No. 10-2011-0102530, filed on Oct. 7, 2011, which is incorporated herein by reference.

FIELD OF THE INVENTION

The present invention relates to a transparent conductive material and a technology for reducing electromagnetic waves, and, more particularly, to a transparent film for reducing electromagnetic waves radiated from radio communication terminals to the human body, and a method of manufacturing the same.

BACKGROUND OF THE INVENTION

Recently, with the rapid advance in IT (Information Technology) and the increased desire for communication, radio communication appliances, such as portable terminals and the like, have become necessities of modern people. However, as such radio communication appliances are increasingly used, the influence of electromagnetic waves generated from portable terminals on the human body is becoming an important issue. For example, the influence of electromagnetic waves on the human body in the frequency band of currently-used mobile phones has become an issue. Further, it has been reported that electromagnetic waves can influence various kinds of diseases such as leukemia, brain tumors, headaches, amblyopia, electroencephalogram abnormality occurring when electromagnetic waves accumulate in the human body, male reproductive function disorder, and the like.

Particularly, in Jun. 1, 2011, International Agency for Research on Cancer (IARC), which is a research institution affiliated with the World Health Organization (WHO), reported that the danger of causing brain cancer is increased when a mobile phone is used. The electromagnetic waves generated from mobile phone conversations are classified as a 2B-grade cancer-causing material, which is the third highest grade of cancer-causing material. Exhaust gas discharged from an automobile engine belongs to the 2B-grade cancer-causing material. WHO has announced the opinion that there is no indisputable evidence showing the correlation between the use of a mobile phone and the generation of cancer. However, such research reversed this opinion.

The WHO suggests the following guidelines: 1) children must not use a mobile phone if it is not urgent, 2) a mobile phone must not be placed near the human body, 3) a telephone must be used at the time of a long conversation, and 4) a letter message must be used if possible. However, mobile phones have become necessities for daily life, so it is obvious that persons requiring a lot of mobile phone conversation will be influenced by these guidelines.

Thus, in advanced countries, various efforts have been made to prevent users from being exposed to electromagnetic waves when using a mobile phone. For example, in England, mobile phones are sold together with the warning sentence "health is endangered by the excessive use of a mobile phone".

Further, attempts have been made to develop electronic products for minimizing the generation rate of electromagnetic waves, and research into technologies for reducing the inevitably-generated electromagnetic waves has been continuously carried out.

Even in Korea, like advanced countries, there are standards regarding the specific absorption rate (SAR) of electromagnetic waves in the human body and these standards are enforced. Mobile phones can be sold in the market only when they comply with these standards. However, even in Korea, like the announcement of the WHO, the influence of electromagnetic waves generated from a mobile phone on the human body is continuously being issued, and these standards cannot completely alleviate the anxiety and worry of a normal person although they are provided and enforced.

All the electronic products carried or used by users generate electromagnetic waves, and, particularly, radio communication terminals, such as mobile phones and the like, which transmit and receive radio waves of a specific frequency using an antenna, generate a large amount of electromagnetic waves. Therefore, different research and various technologies for reducing electromagnetic waves to allow the electromagnetic waves not to have an influence on the human body have been conducted, but no particular plan has been formulated.

Therefore, it is required to develop methods of reducing the influence of electromagnetic waves on the human body even when a mobile phone complies with the standards.

SUMMARY OF THE INVENTION

In view of the above, the present invention provides a transparent film for reducing electromagnetic waves radiated from radio communication terminals to the human body, and a method of manufacturing the same.

In accordance with a first aspect of the present invention, there is provided a method of manufacturing a transparent film for reducing electromagnetic waves, the method including: forming a first dielectric layer; and forming a pattern layer on the first dielectric layer, wherein the pattern layer is made of a transparent electrode material having surface resistance.

In accordance with a second aspect of the present invention, there is provided a method of manufacturing a transparent film for reducing electromagnetic waves, the method including: forming a first dielectric layer using PET or urethane; forming a transparent electrode layer on the first dielectric layer using ITO (indium tin oxide) or CNT (carbon nanotube) having a surface resistance pattern layer, and then etching the transparent electrode layer to form a pattern layer; and forming a second dielectric layer using PET (Poly Ethylene Terephthalate) or urethane.

In accordance with a third aspect of the present invention, there is provided a transparent film for reducing electromagnetic waves, which includes: a first dielectric layer; and a pattern layer formed on the first dielectric layer, the pattern layer being made of a transparent electrode material having surface resistance.

According to the transparent film for reducing electromagnetic waves and the method of manufacturing the same, a conventional metal conductor-based FSS structure is fabricated into a transparent FSS structure using a transparent electrode material, thus improving the performance of absorbing electromagnetic waves in addition to the conventional characteristic of selectively blocking and transmitting the electromagnetic waves of a desired frequency band. When such a transparent FSS structure is applied to a liquid crystal protection film of a mobile phone, the function of protecting the mobile phone can be maintained without influencing the performance of the mobile phone, and only the electromagnetic waves radiated from the mobile phone to the head of the human body can be reduced during a conversation.

In this case, the transparent film for reducing electromagnetic waves can be freely designed as long as the transparent FSS structure does not have a negative influence on the original performance of the mobile phone, because the intensity of the electromagnetic waves reflected in a direction opposite to the head can be controlled by the electromagnetic wave absorption performance of the transparent FSS structure. That is, since the transparent FSS structure blocks and absorbs only the electromagnetic waves of a transmission frequency band in the conversation mode, it does not influence the electromagnetic waves of other frequency bands such as a receiving frequency band, a wireless LAN frequency band and the like in non-conversation mode.

As such, when the transparent film having a function of reducing electromagnetic waves in addition to a function of protecting a display of a mobile phone is used, the direct influence of electromagnetic waves on mobile phone users can be reduced, and the indirect stress of electromagnetic waves on mobile phone users can be prevented.

BRIEF DESCRIPTION OF THE DRAWINGS

The objects and features of the present invention will become apparent from the following detailed description taken in conjunction with the accompanying drawings, in which.

DETAILED DESCRIPTION OF THE EMBODIMENTS

Figure 1:
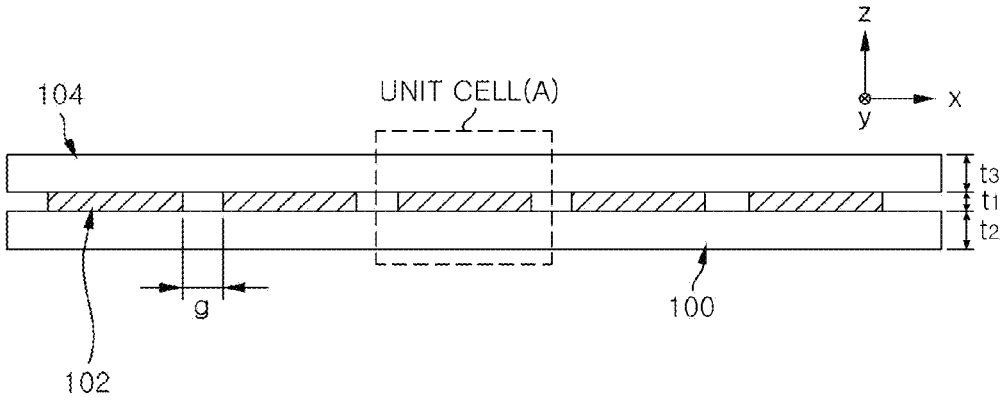
FIG. 1 illustrates a sectional view of a protection film for a mobile phone display including a frequency selective surface (FSS) structure in accordance with an embodiment of the present invention.

Advantages and features of the invention and methods of accomplishing the same may be understood more readily by reference to the following detailed description of embodiments and the accompanying drawings. The invention may, however, be embodied in many different forms and should not be construed as being limited to the embodiments set forth herein. Rather, these embodiments are provided so that this disclosure will be thorough and complete and will fully convey the concept of the invention to those skilled in the art, and the invention will only be defined by the appended claims. Like reference numerals refer to like elements throughout the specification.

In the following description of the present invention, if the detailed description of the already known structure and operation may confuse the subject matter of the present invention, the detailed description thereof will be omitted. The following terms are terminologies defined by considering functions in the embodiments of the present invention and may be changed operators intend for the invention and practice. Hence, the terms need to be defined throughout the description of the present invention. An embodiment of the present invention provides a transparent film for reducing electromagnetic waves, which can reduce the electromagnetic waves radiated from portable electronic appliances to the head of the human body during a conversation by applying a frequency selective surface (FSS) structure to a transparent protective film that can adhere onto a screen of the electronic appliance, and which can reduce the electromagnetic waves radiated from radio communication terminals to the head of the human body during a conversation using the radio communication terminal, and a method of manufacturing the same.

The frequency selective surface (FSS) is a surface which is artificially fabricated such that vertically- or arbitrarily-incident electromagnetic waves of a desired frequency band can be selectively transmitted or blocked. The FSS can be obtained by arranging conductive planes or aperture planes to have a spatially constant period. In this case, the region of the FSS corresponding to a spatially single period is called "a unit cell".

Further, the shape of a conductive plane or aperture plane in the unit cell is called "a unit cell pattern or FSS pattern". The unit cell pattern may have various shapes, such as a triangle, a quadrangle, a circle, a Hilbert curve, a Sierpinski space filling curve, and the like. The frequency response characteristics of FSS are determined depending on the geometric shape of the unit cell pattern, the form and period of arrangement of the unit cells, the material characteristics of dielectric layers formed on both sides of a transparent FSS pattern layer, and the like.

Generally, the currently-proposed FSS has a structure in which a metal conductor pattern is etched on a dielectric, and functions to block and reflect electromagnetic waves of a desired specific frequency band or to transmit electromagnetic waves of a desired specific frequency band and reflect electromagnetic waves of other frequency bands using design parameters. In the case where the total reflection of electromagnetic waves is not required although the blocking thereof is required, when the FSS pattern is formed of a material having surface resistance, not a metal which is a pure conductor, the absorption and reflection of electromagnetic waves can simultaneously occur. Since such a FSS structure can be fabricated in the form of a thin film, it can function to filter the incident electromagnetic waves of a specific frequency when it is attached to the desired surface.

Meanwhile, a metal conductor is a material having approximately infinite electroconductivity. Currently, a transparent electrode material having physical properties similar to those of a metal conductor is generally used to manufacture a transparent display panel such as a touch screen or the like.

Examples of the transparent electrode material may include ITO (indium tin oxide) and CNT (carbon nanotube). Such a transparent electrode material satisfies both excellent electroconductivity (surface resistance: 1000 Ohm/sq or less) and high transmission (transmissivity in a visible light range of 380~780 nm: 80% or more). The surface resistance thereof may be varied according to the correlation between surface resistance and transmissivity.

Thus, when this FSS technology is put to practical use, the electromagnetic waves of a specific frequency band, radiated from a radio communication terminal to the human body, can be blocked. In this case, when the FSS pattern is formed of a transparent electrode material in light of the negative influence of the electromagnetic waves which are blocked by the FSS structure and totally reflected in the opposite direction, the FSS structure has transparency and can absorb the electromagnetic waves and not totally reflect them.

As such, when a transparent film for reducing electromagnetic waves, including the FSS structure based on the transparent conductive material, is realized, the electromagnetic waves radiated from a radio communication terminal can be reduced, thus minimizing the influence of electromagnetic waves on the human body. Particularly, when a conversation is carried out using a mobile phone which is an example of a radio communication terminal, the electromagnetic waves radiated from the mobile phone to the head of the human body can be reduced, thus reducing the direct and indirect influences of the electromagnetic waves radiated from the mobile phone on the head of the human body.

A mobile phone includes a transparent display such as an LCD (Liquid Crystal Display), LED (Light Emitting Diode), AMOLED (Active Matrix Organic Light-Emitting Diode) or the like. A mobile phone is generally mounted with protective glass in order to protect such a transparent display. Nevertheless, most users additionally purchase a transparent protective film (liquid crystal protection film) in order to prevent the protective glass from being scratched and broken.

Meanwhile, wireless wearable devices, which can be put on the human body, will be developed in the near future. Such a wireless wearable device can generate electromagnetic waves harmful to the human body at the time of radio communication because it comes into contact with parts of the human body, such as a head, a wrist, an arm, a chest, a leg or the like. In this case, when the protective film having a transparent FSS structure in accordance with an embodiment of the present invention is applied to the contact surface between the wireless wearable device and the human body, the electromagnetic waves running toward the human body can be reduced.

Therefore, in the present invention, when the transparent FSS structure is applied to a transparent protective film to protect a mobile phone or a wireless wearable device, the performance of the mobile phone or wireless wearable device can be maintained, and simultaneously the electromagnetic waves proceeding towards the human body, particularly the head, can be reduced.

Hereinafter, embodiments of the present invention will be described in detail with reference to the accompanying drawings.

FIG. 1 illustrates a sectional view of a protection film for a display of mobile phones with a transparent frequency selective surface (FSS) structure in accordance with an embodiment of the present invention.

Referring to FIG. 1, a protection film in accordance with an embodiment of the present invention includes a transparent FSS structure.

The protection film may be detachably attached to a display unit of a portable electronic appliance or a contact surface of a wireless wearable device. The transparent film is configured such that a unit cell A is repeatedly and periodically arranged. The unit cell A includes a first dielectric layer ($\in_{r1}$) 100, and a transparent FSS pattern layer 102 formed on the first dielectric layer 100 and made of a transparent electrode material having surface resistance Rs(Ohm/sq).

The transparent FSS pattern layer 102 is printed on the first dielectric layer 100. In order to protect the transparent FSS pattern layer 102 printed on the first dielectric layer 100, the unit cell A further includes a second dielectric layer ($\in_{r2}$) 104 on the transparent FSS pattern layer 102. In this embodiment, each of the first dielectric layer 100 and the second dielectric layer 104 may be a transparent film such as a PET (polyethylene terephthalate) film, a urethane film or the like, which may be used as a protection film for a liquid crystal display of a mobile phone.

The unit cell A including the first dielectric layer 100 and the transparent FSS pattern layer 102 having surface resistance is configured such that loss is added to the frequency selective surface (FSS), and serves to reflect specific incident electromagnetic waves by frequency filtering and to control the phase in a dielectric.

The unit cell A is formed in the shape of an electromagnetic bandgap. The electrical length of the transparent FSS pattern layer 102 determines an inductance L, and the gap between lines and the gap between the unit cells A determine a capacitance C, thus determining a transmission frequency and a blocking frequency using L-C.

More specifically, in addition to the electrical length of the transparent FSS pattern layer 102, the thicknesses or heights $t_2$, $t_1$, and $t_3$ of the first dielectric layer 100, the transparent FSS pattern layer 102 and the second dielectric layer 104; the dielectric constants $\in_{r1}$ and $\in_{r2}$ of the first dielectric layer 100 and the second dielectric layer 104; and the gap g between the unit cells A act as filtering parameters, thus controlling the electromagnetic wave blocking band and the performance.

Alternatively, the unit cell A of FIG. 1 may also be configured such that other FSS pattern layers are disposed beneath the first dielectric layer 100 or on the second dielectric layer 104 to form a multi-layered FSS structure, thus obtaining multiple resonance characteristics.

Figure 2:
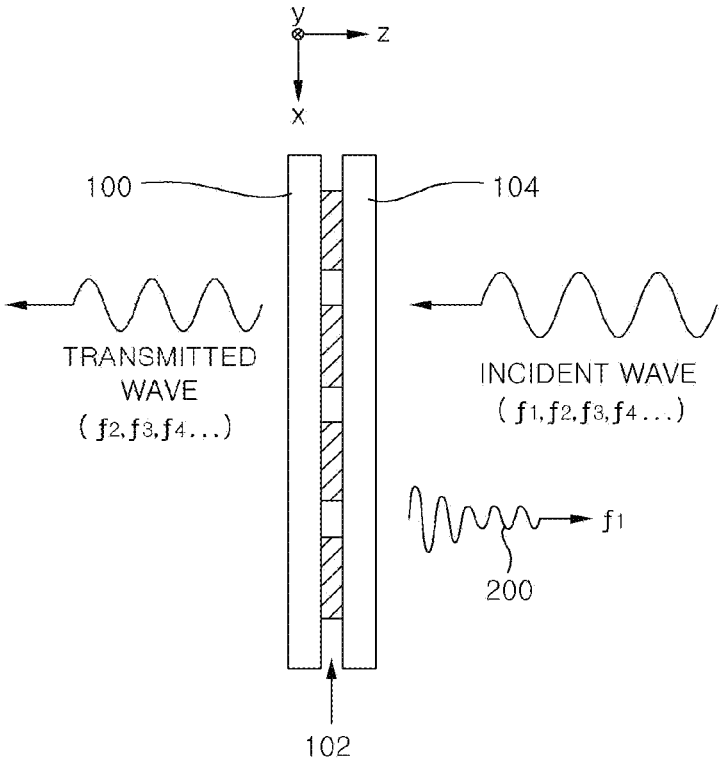
FIG. 2 is a schematic view illustrating the conception of blocking and reducing electromagnetic waves using the mobile phone display protection film including an FSS structure in accordance with an embodiment of the present invention.

FIG. 2 is a schematic view illustrating the conception of blocking and reducing electromagnetic waves using the mobile phone display protection film including an FSS structure in accordance with an embodiment of the present invention.

Referring to FIG. 2, in order to selectively block the electromagnetic waves of an f1 frequency band 200 (for example, a WCDMA frequency band of 1.9 GHz), when the transparent FSS structure of FIG. 1 is used, only the electromagnetic waves of the f1 frequency band 200 can be blocked, and the electromagnetic waves of other frequency bands can be transmitted without being subjected to any additional influence.

In this case, the blocked electromagnetic waves of the f1 frequency band 200 are totally reflected. However, when the transparent FSS structure is fabricated to have the desired surface resistance Rs, a part of the electromagnetic waves of the f1 frequency band 200 can be absorbed by the transparent FSS structure, and another part thereof can be reflected by the transparent FSS structure.

This transparent FSS structure is useful for reducing the influence of reflected waves. The transparent FSS structure having the desired surface resistance can be made of a transparent electrode material. Consequently, the transparent FSS pattern layer 102 is printed on the first dielectric layer 100, so that the transparent film including the FSS pattern layer 102 printed on the first dielectric layer 100 can be used as a display protection film for mobile phones, with the result that the electromagnetic waves of a transmission frequency band, which are transferred to the head of the human body during a conversation, can be selectively reduced.

FIGS. 3A to 3D are sectional views showing structures, each of which is used as an FSS unit cell pattern, in accordance with an embodiment of the present invention.

Figure 3A:
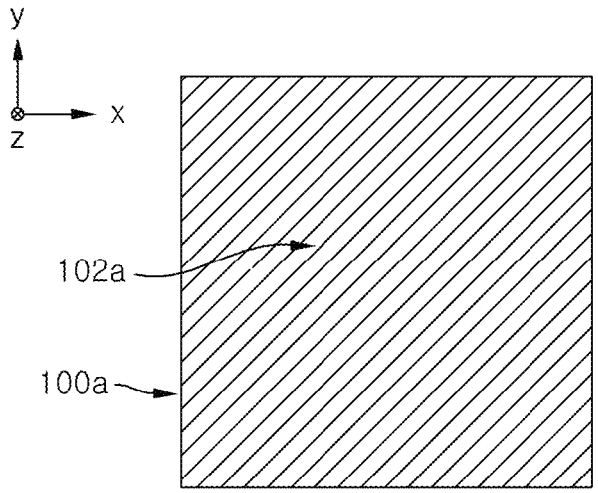
FIGS. 3A to 3D are sectional views showing structures, each of which can be used as an FSS unit cell pattern, in accordance with an embodiment of the present invention.
Figure 3B:
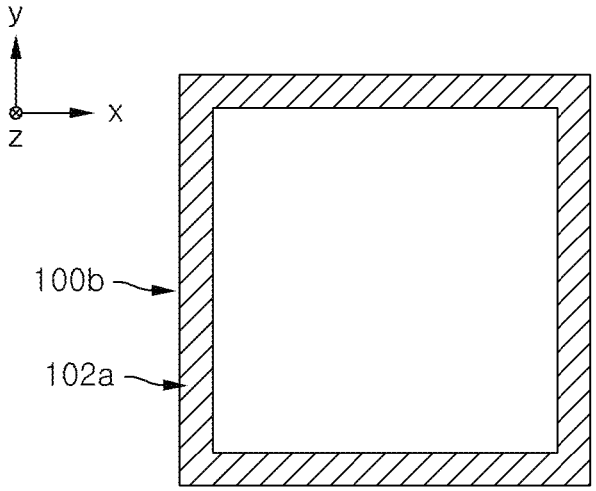

Referring to FIG. 3A, a quadrangular unit cell pattern 102*a* is formed on a unit cell 100*a*. The unit cell 100*a* may be formed thereon with polygonal unit cell patterns, such as a triangular unit cell pattern, a circular unit cell pattern, and the like. Referring to FIG. 3B, a rim-shaped unit cell pattern 102*b* is formed on a unit cell 100*b*. The unit cell 100*b* may be formed thereon with various unit cell patterns, such as a loop-shaped pattern, a pattern using a Hilbert curve, a pattern using a Sierpinski space filling curve, and the like.

That is, the electrical length of the unit cell pattern depending on the shape thereof determines an inductance L, and the gap between lines and the gap between the unit cells A determine a capacitance C to obtain an L-C resonance circuit, thus determining a transmission frequency and a blocking frequency using the obtained L-C resonance circuit.

Since the transparent FSS structure in accordance with an embodiment of the present invention has the surface resistance $R_s$, it may be construed that the obtained L-C resonance circuit is an R-L-C resonance circuit. Therefore, the electromagnetic waves of a desired frequency band can be blocked only when the unit cell pattern can induce suitable L and C.

In this view, the unit cell patterns 102*a* and 102*b* of FIGS. 3A and 3B may not create a resonance band because of very small capacitance C. That is, the unit cell patterns 102*a* and 102*b* of FIGS. 3A and 3B may not selectively block or transmit the electromagnetic waves of a specific frequency band because they act as a low pass filter and a high pass filter.

Figure 3C:
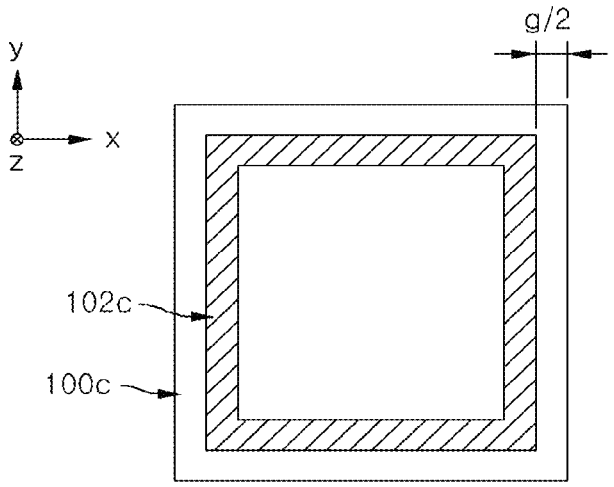
Figure 3D:
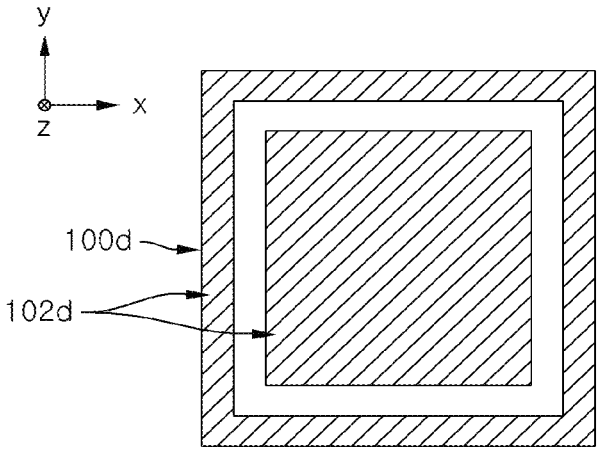

FIGS. 3C to 3D show the unit cell pattern structures for increasing capacitance C. FIG. 3C shows a unit cell pattern structure in which the gap g/2 between unit cell patterns 102*c* formed on a unit cell 100*c* is arranged, and FIG. 3D shows a unit cell pattern structure in which a unit cell pattern 102*d* provided at the opening thereof with a rectangular patch is formed on a unit cell 100*d* to increase the capacitance C. These two unit cell pattern structures create an L-C resonance band, thus blocking or transmitting the electromagnetic waves of the L-C resonance band.

Consequently, the size 'a×a' of a unit cell, the electrical length of a unit cell pattern, the gap g between unit cells, the material property $R_s$(Ohm/sq), the dielectric constant $\in_{r1}$ of a dielectric, and the like may become design parameters for determining a blocking frequency bandwidth. The blocking frequency bandwidth can be controlled by changing at least one of the parameters.

Figure 4:
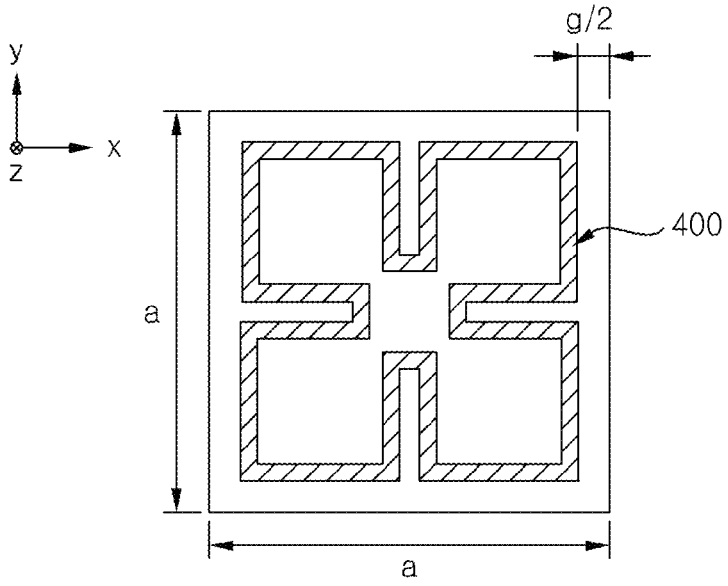
FIG. 4 illustrates a sectional view of an exemplary unit cell pattern to be employed to calculate the electromagnetic wave reduction performance of the protection film with the FSS structure in accordance with an embodiment of the present invention.

FIG. 4 illustrates a sectional view showing an exemplary unit cell pattern to be employed to calculate the electromagnetic wave reduction performance of the protection film with the FSS structure in accordance with an embodiment of the present invention. Referring to FIG. 4, a unit cell pattern 400 shown in FIG. 4 may have the following values:

a=22.5 mm, g=2.5 mm, $t_1$=0.1 mm, $t_2$=0.5 mm, t3=0 mm, $\in_{r1}$=3.24, $R_s$=10 Ohm/sq.

Figure 5A:
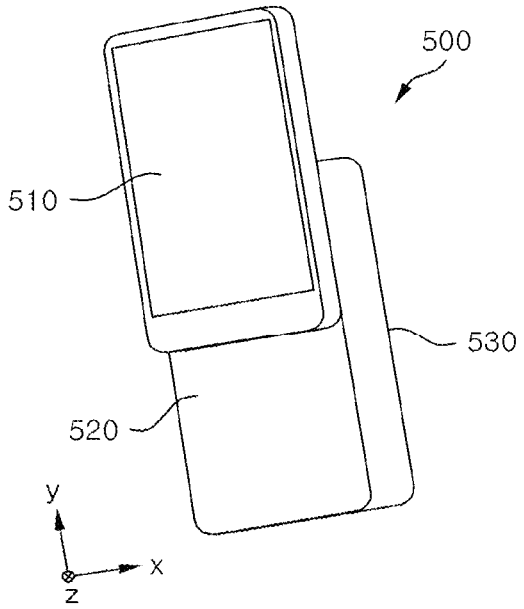
FIGS. 5A and 5B illustrate perspective views of a mobile phone used to conduct a simulation in accordance with an embodiment of the present invention.
Figure 5B:
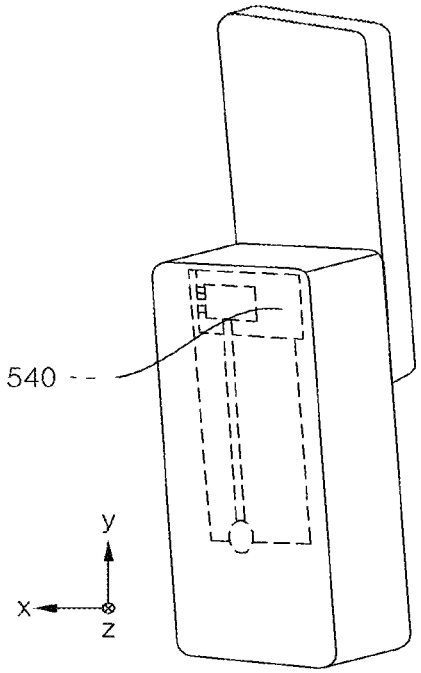

FIGS. 5A and 5B illustrate perspective views of a mobile phone 500 used to conduct a simulation in accordance with an embodiment of the present invention.

A mobile phone 500 is a slide-type mobile phone, and is configured such that a keypad 520 located in a display unit 510 is opened by sliding the display unit 510 upward, as shown in FIG. 5A. An antenna 540 may be mounted in the body 530 of the mobile phone 500, as shown in FIG. 5B. The antenna 540 may be a planar inverted F antenna (PIFA) which is generally used to reduce the specific absorption rate (SAR) of electromagnetic waves by the head of the human body.

The slide-type mobile phone 500 is set forth only to simulate an embodiment of the present, and the embodiment of the present invention is not limited thereto. In the embodiment of the present invention, various types of mobile phones, such as a folder-type mobile phone, a bar-type mobile phone and the like, may be applied. Further, various types of antennas, such as a chip antenna, a meander line antenna (MLA) and the like may be applied in addition to the PIFA antenna.

Figure 6:
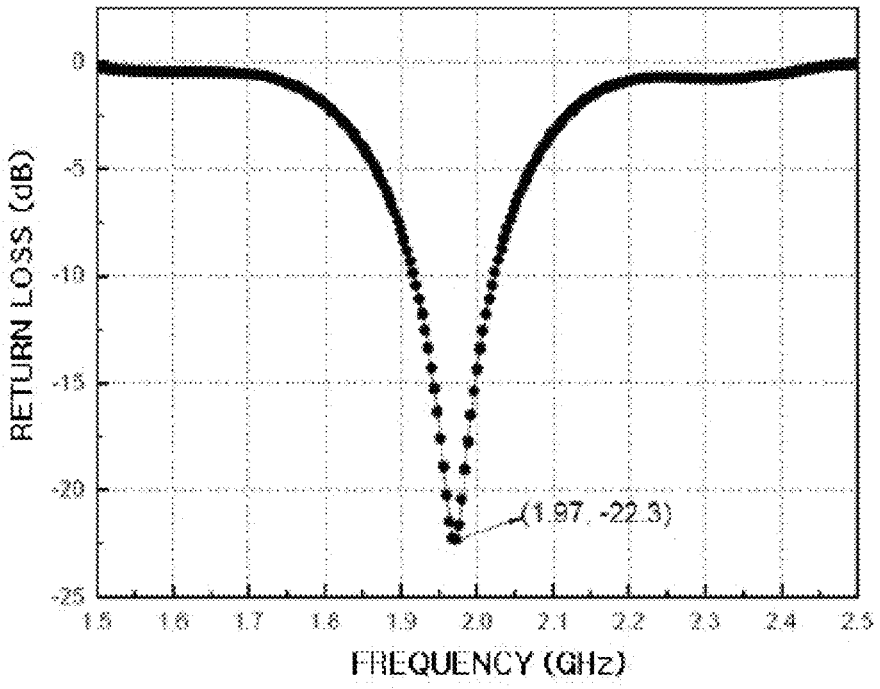
FIG. 6 is a graph showing the results of calculating the return loss of an antenna of the mobile phone shown in FIGS. 5A and 5B while attaching the mobile phone closely to a head of the human body during a phone conversation using the mobile phone in accordance with an embodiment of the present invention.

FIG. 6 is a graph showing the results of calculating the return loss of an antenna of a mobile phone while attaching the mobile phone 500 shown in FIGS. 5A and 5B closely to the head of the human body during conversation using a mobile phone in accordance with an embodiment of the present invention.

Referring to FIG. 6, in order to take into consideration the situation in which a user is performing a conversation using a mobile phone, the mobile phone 500 is aligned on the line between the ear and cheek of the head according to SAR guidelines, and the antenna mounted in the mobile phone 500 is designed such that it is operated in the transmission frequency band of wideband code division multiple access (WCDMA).

From FIG. 6, it can be ascertained that the resonance characteristics of the antenna of the mobile phone 500 are maximized at a frequency of 1.97 GHz when the return loss of the antenna of the mobile phone is −22.3 dB.

Figure 7:
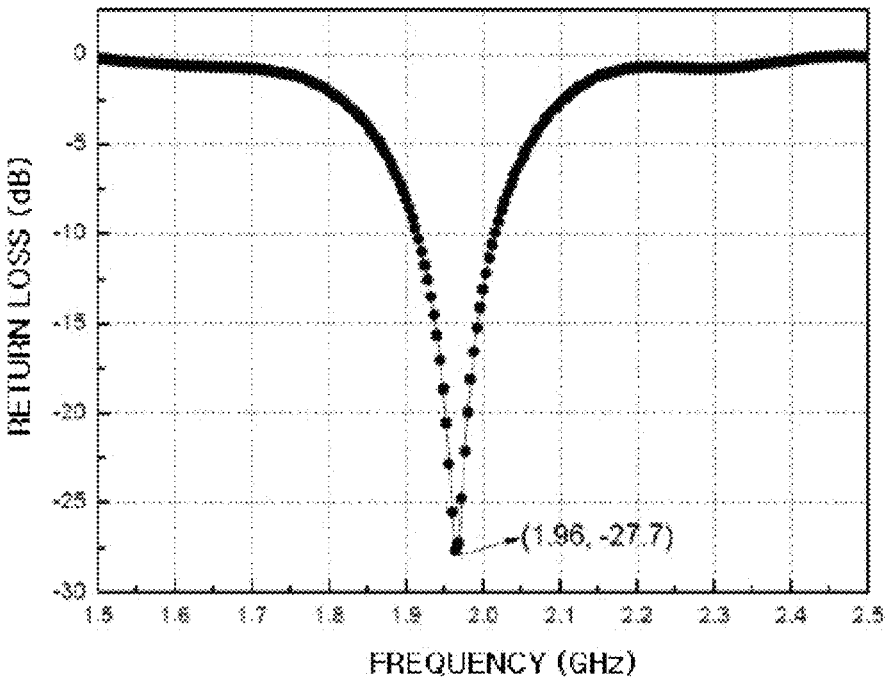
FIG. 7 is a graph showing the results of calculating the return loss of an antenna of the mobile phone shown in FIGS. 5A and 5B mounted with the protection film formed by applying a transparent. FSS structure onto a display of the mobile phone under the same situation as in FIG. 6 in accordance with an embodiment of the present invention.

FIG. 7 is a graph showing the results of calculating the return loss of an antenna of the mobile phone 500 mounted with the protection film formed by applying a transparent FSS structure onto a display of the mobile phone under the same situation as in FIG. 6 in accordance with an embodiment of the present invention.

Referring to FIG. 7, it can be ascertained that the resonance characteristics of the antenna of the mobile phone 500 are maximized at a frequency of 1.96 GHz when the return loss of the antenna of the mobile phone 500 is −27.7 dB. Thus, it can be seen that the performance of the antenna of the mobile phone 500 hardly changes even when the mobile phone is mounted with a display protection film.

Figure 8:
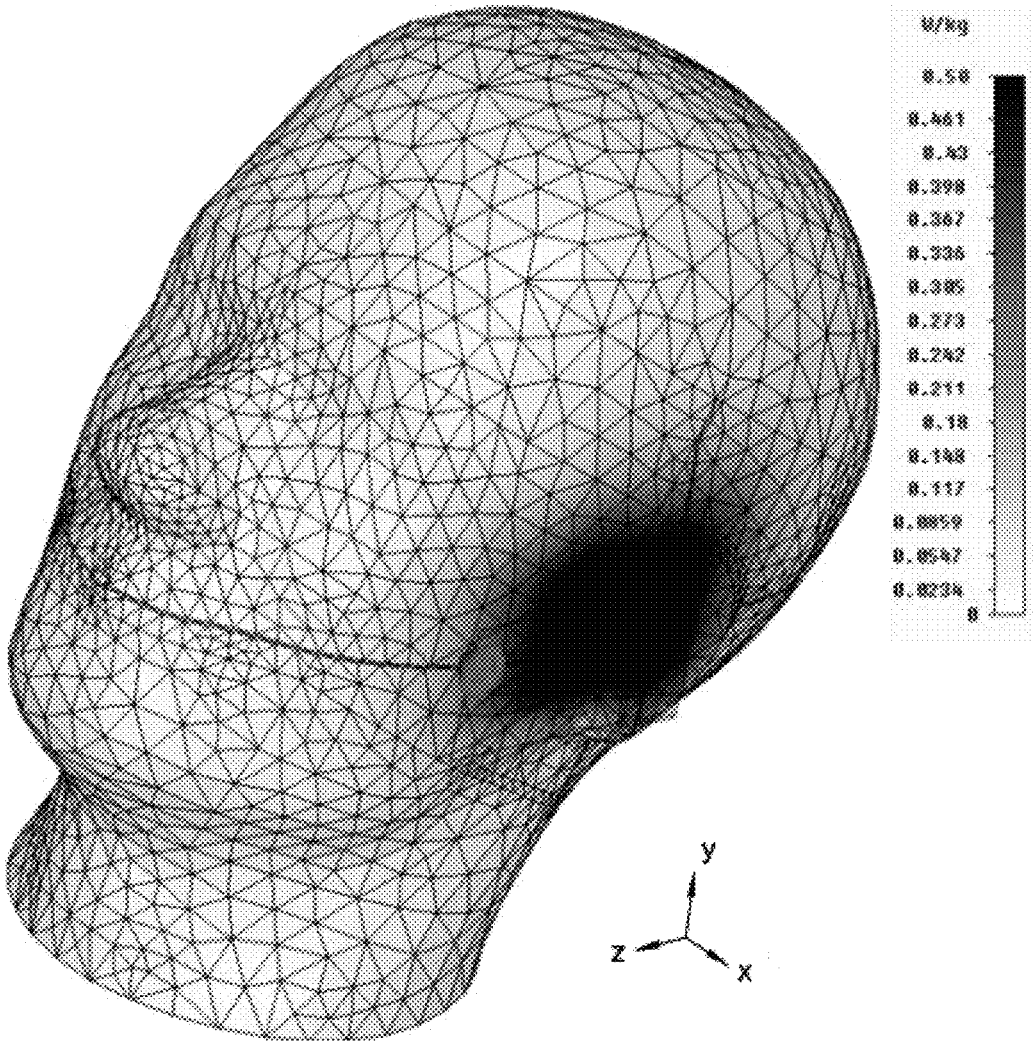
FIG. 8 is a view showing the results of calculating the specific absorption rate (SAR) of electromagnetic waves in the head of the human body carrying the mobile phone shown in FIGS. 5A and 5B under the same situation as in FIG. 6 in accordance with an embodiment of the present invention.

FIG. 8 is a view showing the results of calculating the specific absorption rate (SAR) of electromagnetic waves in the head of the human body using the mobile phone 500 under the same situation as in FIG. 6 in accordance with an embodiment of the present invention.

Referring to FIG. 8, the specific absorption rate (SAR) of electromagnetic waves in the head of the human body is about 0.93 W/kg when the transmission frequency of the mobile phone 500 using the WCDMA band is 1.97 GHz.

Since the mobile phone of FIG. 5, which is used to evaluate the effect of the reduction of electromagnetic waves in accordance with the embodiment of the present invention, is designed to have a case thicker than that of a commonly-used mobile phone, the gap between the antenna and the head in the mobile phone is larger than the gap between the antenna and the head in the commonly-used mobile phone, so it can be ascertained that the SAR of the mobile phone is in compliance with the SAR tolerance limit (1.6 W/kg) of the mobile phones.

Figure 9:
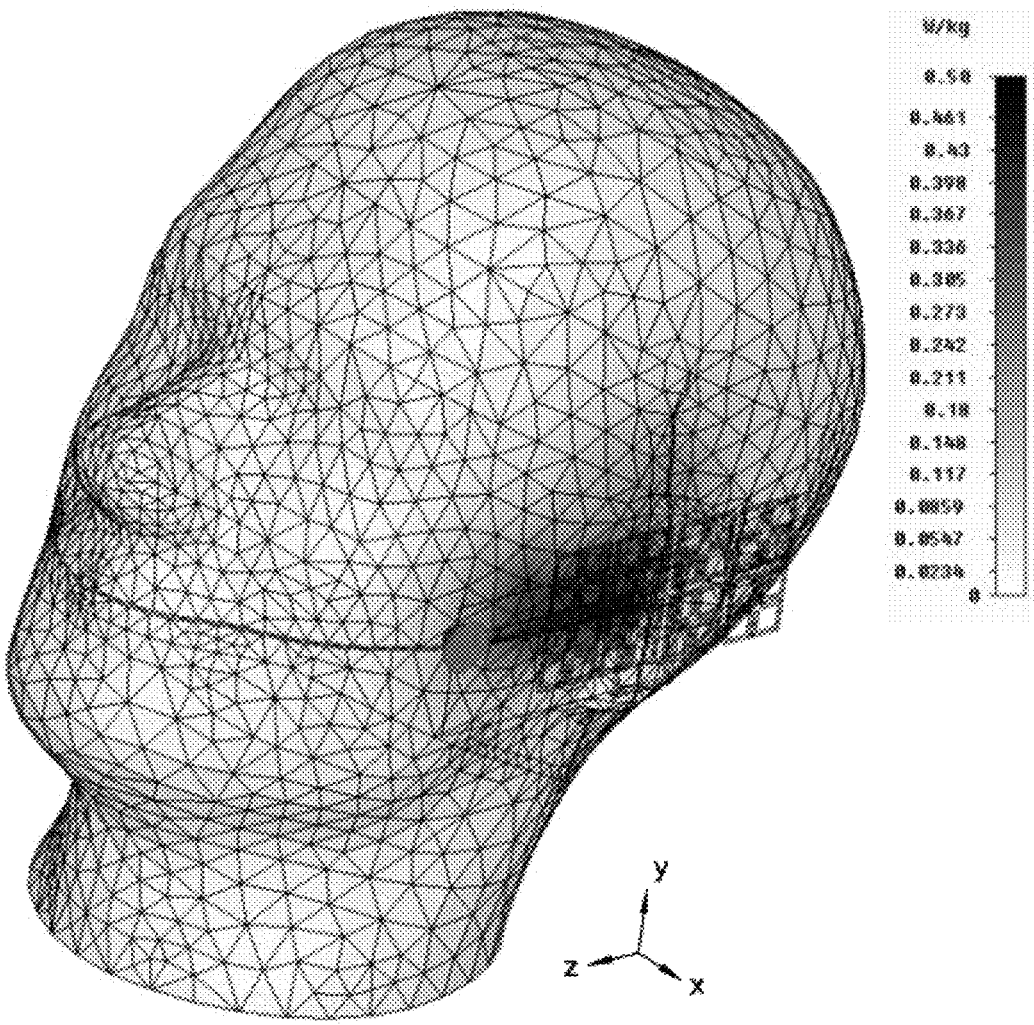
FIG. 9 is a view showing the results of calculating the specific absorption rate (SAR) of electromagnetic waves in the head of the human body using the mobile phone shown in FIGS. 5A and 5B mounted with the protection film formed by applying a transparent FSS structure onto a display of the mobile phone under the same situation as in FIG. 8 in accordance with an embodiment of the present invention.

FIG. 9 is a view showing the results of calculating the specific absorption rate (SAR) of electromagnetic waves in the head of the human body using the mobile phone 500 mounted with the protection film formed by applying a transparent FSS structure onto a display of the mobile phone under the same situation as in FIG. 8 in accordance with an embodiment of the present invention.

Referring to FIG. 9, it can be ascertained that the specific absorption rate (SAR) of electromagnetic waves by the head of the human body is about 0.41 W/kg when the transmission frequency of the mobile phone using the WCDMA band is 1.97 GHz, so the SAR shown in FIG. 9 is reduced by about 56% compared to the SAR shown in FIG. 8. Accordingly, when the protection film of the present invention is applied to a commonly-used mobile phone satisfying the standards, the effect of reduction of electromagnetic waves is about 56%, so that the direct and indirect influences of electromagnetic waves on the human body while carrying out a mobile phone conversation can be greatly reduced.

As described above, in accordance with the transparent film for reducing electromagnetic waves and the method of manufacturing the same, the electromagnetic waves radiated from portable electronic appliances to the head of the human body during a conversation can be reduced by applying a frequency selective surface (FSS) structure to a transparent protective film that can adhere onto a screen of the electronic appliance, and the electromagnetic waves radiated from radio communication terminals to the head of the human body can be reduced during a conversation using the radio communication terminal. While the invention has been shown and described with respect to the embodiments, the present invention is not limited thereto. It will be understood by those skilled in the art that various changes and modifications may be made without departing from the scope of the invention as defined in the following claims.

What is claimed is:

1. A method of manufacturing a transparent film for reducing electromagnetic waves, the film configured to detachably attach to a display unit of a portable electronic appliance or a contact surface of a wireless wearable device, the method comprising:

forming a first dielectric layer; and forming a pattern layer on the first dielectric layer, wherein the pattern layer is made of a transparent electrode material having surface resistance.

2. The method of claim 1, wherein the transparent film includes periodically-arranged unit cells, and each of the unit cells includes the first dielectric layer and the pattern layer.

3. The method of claim 1, wherein the pattern layer has at least one shape of a triangle, a quadrangle, a circle, a Hilbert curve and a Sierpinski space filling curve.

4. The method of claim 1, wherein the transparent film includes periodically-arranged unit cells; and each of the unit cells includes the first dielectric layer, the pattern layer and a second dielectric layer, wherein the pattern layer is formed between the first dielectric layer and the second dielectric layer.

5. The method of claim 4, wherein each of the first dielectric layer and the second dielectric layer is made of polyethylene terephthalate (PET) or urethane.

6. The method of claim 4, wherein the pattern layer is formed beneath the first dielectric layer or on the second dielectric layer to form a multi-layered structure.

7. The method of claim 4, wherein the transparent film controls a blocking frequency bandwidth by changing at least one of the size of the unit cell, the gap between the pattern layers of the unit cell, the material property, thickness, electrical length of the pattern layer, the thickness and dielectric constant of the first dielectric layer, and the thickness and dielectric constant of the second dielectric layer.

8. The method of claim 1, wherein the transparent electrode material is indium tin oxide (ITO) or carbon nanotubes (CNT).

9. The method of claim 1, wherein the transparent electrode material has electroconductivity with surface resistance of 1000 Ohm/sq or less and has a transmissivity of 80% or more in a visible light range.

10. A method of manufacturing a transparent film for reducing electromagnetic waves, the film configured to detachably attach to a display unit of a portable electronic appliance or a contact surface of a wireless wearable device, the method comprising:

forming a first dielectric layer using PET or urethane;

forming a transparent electrode layer on the first dielectric layer using ITO (indium tin oxide) or CNT (carbon nanotube) having a surface resistance pattern layer, and then etching the transparent electrode layer to form a pattern layer; and forming a second dielectric layer using PET (Poly Ethylene Terephthalate) or urethane.

11. A protective film for reducing electromagnetic waves, the protective film comprising:

a transparent film configured to detachably attach to a display unit of a portable electronic appliance or a contact surface of a wireless wearable device;

a first dielectric layer; and a pattern layer formed on the first dielectric layer, the pattern layer being made of a transparent electrode material having surface resistance.

12. The protective film of claim 11, wherein the protective film includes periodically-arranged unit cells, and each of the unit cells includes the first dielectric layer and the pattern layer.

13. The protective film of claim 11, wherein the pattern layer has at least one shape of a triangle, a quadrangle, a circle, a Hilbert curve and a Sierpinski space filling curve.

14. The protective film of claim 11, wherein the protective film includes periodically-arranged unit cells; each of the unit cells includes the first dielectric layer, the pattern layer and a second dielectric layer; and the pattern layer is formed between the first dielectric layer and the second dielectric layer.

15. The protective film of claim 14, wherein each of the first dielectric layer and the second dielectric layer is made of polyethylene terephthalate (PET) or urethane, and the transparent electrode material constituting the pattern layer is indium tin oxide (ITO) or carbon nanotubes (CNT).

16. The protective film of claim 14, wherein the pattern layer is formed beneath the first dielectric layer or on the second dielectric layer to form a multi-layered structure.

17. The protective film of claim 14, wherein the protective film controls a blocking frequency bandwidth by changing at least one of the size of the unit cell, the gap between the pattern layers of the unit cell, the material property, thickness, electrical length of the pattern layer, the thickness and dielectric constant of the first dielectric layer, and the thickness and dielectric constant of the second dielectric layer.

18. The protective film of claim 11, wherein the transparent electrode material has electroconductivity with a surface resistance of 1000 Ohm/sq or less and has a transmissivity of 80% or more in a visible light range.

* * * * *